United States Patent [19]

Matsuda et al.

[11] Patent Number: 4,692,092

[45] Date of Patent: Sep. 8, 1987

[54] FUEL PUMP APPARATUS FOR INTERNAL COMBUSTION ENGINE

[75] Inventors: Takeshi Matsuda; Masasi Miyamoto, both of Kariya; Toshihiro Takei, Okazaki, all of Japan

[73] Assignee: Nippondenso Co., Ltd., Kariya, Japan

[21] Appl. No.: 946,164

[22] Filed: Dec. 23, 1986

Related U.S. Application Data

[63] Continuation of Ser. No. 671,309, Nov. 14, 1984, abandoned.

[30] Foreign Application Priority Data

Nov. 25, 1983 [JP] Japan ..... 58-220524
Apr. 16, 1984 [JP] Japan ..... 59-77275

[51] Int. Cl.[4] ..... F04D 9/00

[52] U.S. Cl. ..... 415/143; 417/366; 55/203

[58] Field of Search ..... 415/53 T, 213 T, 143, 415/108, 198.1, 198.2, 144, 168; 417/410, 366, 424, 423 R, 244; 55/203, 406

[56] References Cited

U.S. PATENT DOCUMENTS

| | | | |
|---|---|---|---|
| 2,003,350 | 6/1935 | Durdin, III | 415/53 T |
| 2,217,211 | 10/1940 | Brady | 415/53 T |
| 3,203,354 | 8/1965 | Pedersen | 415/143 |
| 3,418,991 | 12/1968 | Shultz et al. | 417/366 |
| 3,686,831 | 8/1972 | Libby | 55/406 |
| 3,881,839 | 5/1975 | MacManus | 415/213 T |
| 3,973,867 | 8/1976 | Lee | 415/143 |
| 4,205,947 | 6/1980 | Ruhl et al. | 417/366 |
| 4,209,284 | 6/1980 | Lochmann et al. | 417/366 |
| 4,408,952 | 10/1983 | Schweinfurter | 415/53 T |
| 4,410,337 | 10/1983 | Gullichsen et al. | 55/203 |
| 4,435,193 | 3/1984 | Gullichsen et al. | 55/203 |
| 4,449,891 | 5/1984 | Kemmner | 415/53 T |
| 4,563,198 | 1/1986 | Houtchens | 55/203 |

FOREIGN PATENT DOCUMENTS

| | | | |
|---|---|---|---|
| 447177 | 3/1948 | Canada | 415/143 |
| 512835 | 5/1955 | Canada | 415/53 T |
| 932386 | 7/1963 | United Kingdom | 415/143 |

*Primary Examiner*—Robert E. Garrett
*Assistant Examiner*—John Kwon
*Attorney, Agent, or Firm*—Cushman, Darby & Cushman

[57] ABSTRACT

A fuel pump apparatus having two-stage pump sections and a vapor discharge port. A first impeller of a first stage pump section is attached to a vertically lower surface of a second impeller of a second stage pump section, the second impeller having a larger diameter than the first impeller. A vapor discharge port is formed in the second impeller at a radially inward portion thereof to open to a radially inwardly portion of a first pump passage. Fuel vapor is separated from liquid fuel at the first stage pump section and the liquid fuel is pressurized at the second stage pump section.

9 Claims, 8 Drawing Figures

FUEL PUMP APPARATUS FOR INTERNAL COMBUSTION ENGINE

This is a continuation of application Ser. No. 671,309, filed Nov. 14, 1984 which was abandoned upon the filing hereof.

BACKGROUND OF INVENTION

1. Field of Invention

The present invention relates to a fuel pump apparatus for an internal combustion engine, and more particularly to a fuel pump installed in a fuel tank for pumping up and feeding fuel to a carburetor or fuel injection nozzles mounted on an intake manifold of the engine.

2. Brief Description Prior Arts

In a field of the fuel pump of the above kind, various types of fuel pumps have been known and practically used, such as a roller pump, a centrifugal pump, an axial flow type pump, a regenerative type pump and so on. The regenerative type pump having a closed vane impeller is recently more often used since it produces a high discharge pressure (2 to 3 kg/cm$^2$) with less noise and pulsated discharge pressure than roller pumps.

However, since the fuel in a fluid passage of the regenerative type pump is agitated by a plurality of vanes of the impeller, fuel vapor and/or cavitation is easily produced. Particularly when the regenerative type pump is used in a severe condition, such as at a high temperature and/or at a low ambient pressure, the fuel vapor is produced and retained in a fuel passage, causing a so-called vapor-lock with a result that the pump can no longer pump up and feed the fuel although the impeller is rotated.

In order to avoid such a vapor lock, it is known in the art, for example in U.S. Pat. No. 3,418,991, to provide a small vapor discharge port in a pump housing for communicating a pump chamber with the outside of the pump chamber, so that a small amount of fuel flows out of the pump chamber through the port along with the fuel vapor.

According to the observations of the present inventors, a satisfactory result for avoiding the vapor-lock cannot be obtained when the small vapor discharge port is simply formed in the pump housing and particularly when the pump is operated under the above-described severe condition.

SUMMARY OF INVENTION

It is, therefore, an object of the present invention to provide a fuel pump which can avoid a vapor lock and improve its pump efficiency.

According to an aspect of the present invention, the fuel pump has a two-stage pump section. The first-stage pump section is comprised of a small-diameter (first) impeller of a centrifugal type, a regenerative type or the like and a first fuel passage surrounding an outer peripheral portion of the first impeller, while the second-stage pump section is comprised of a large-diameter (second) impeller of a regenerative type and a second fuel passage surrounding an outer peripheral portion of the second impeller, an outlet portion of the first fuel passage being communicated with an inlet portion of the second fuel passage so that a fuel pressurized in the first-stage pump section is introduced into the second-stage pump section. The second impeller is vertically arranged at an upper side of the first impeller and the second impeller is formed with at least one vapor discharge port at a radially inward portion thereof so that the vapor discharge port communicates with a radially inward portion of the first fuel passage. A discharge passage is further formed in a pump housing, being communicated with the vapor discharge port, whereby the fuel vapor, if any, is gathered at radially inward portion of the first fuel passage due to a smaller centrifugal force applied to the fuel vapor than the centrifugal force applied to the liquid fuel, and the fuel vapor is effectively removed from the pressurized fuel in the first fuel passage.

DETAILED DESCRIPTION OF PREFERRED EMBODIMENTS

Figure 1:
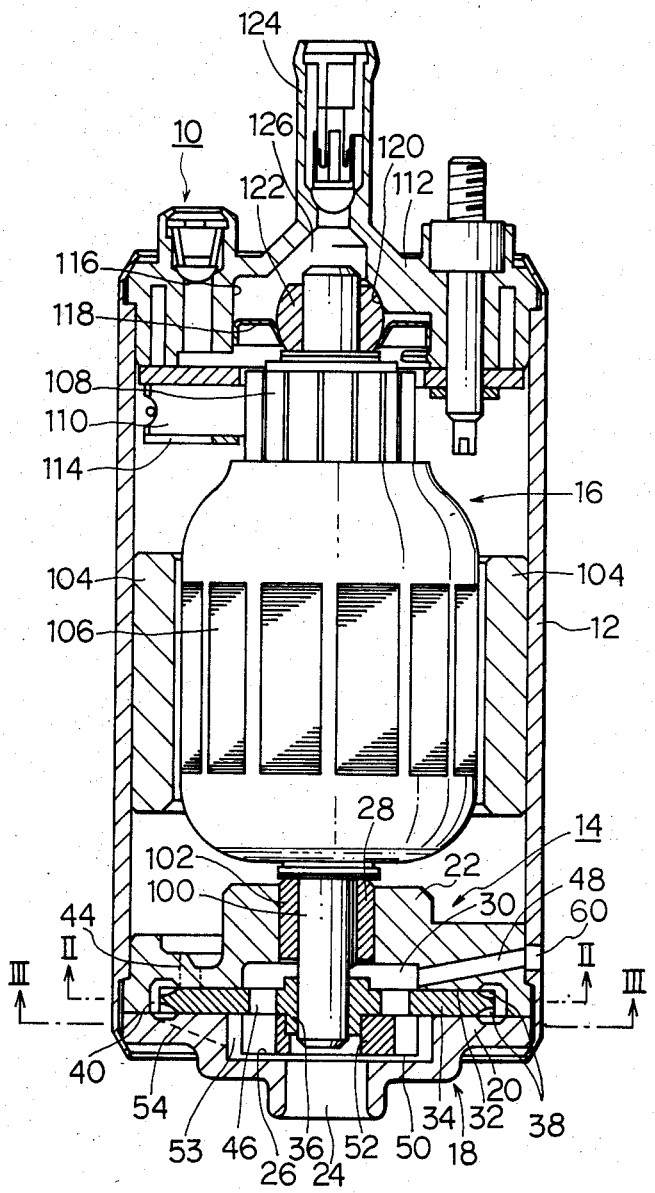
FIG. 1 is an axial sectional view of an electrically operated fuel pump apparatus according to a first embodiment of the present invention.
Figure 2:
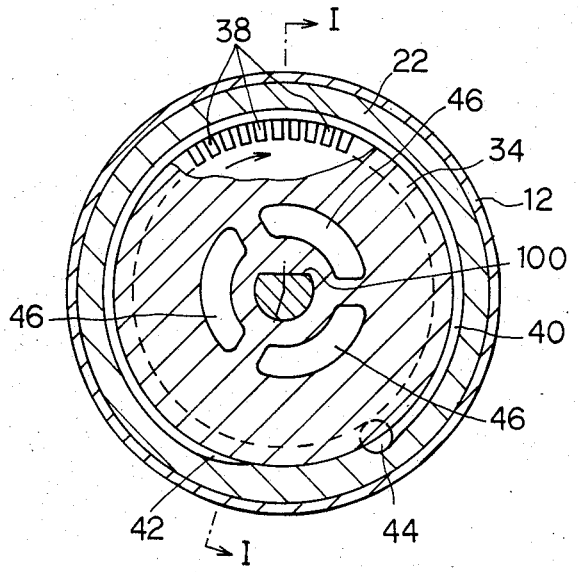
FIG. 2 is a cross-sectional view of a second pump section taken along a line II—II in FIG. 1.
Figure 3:
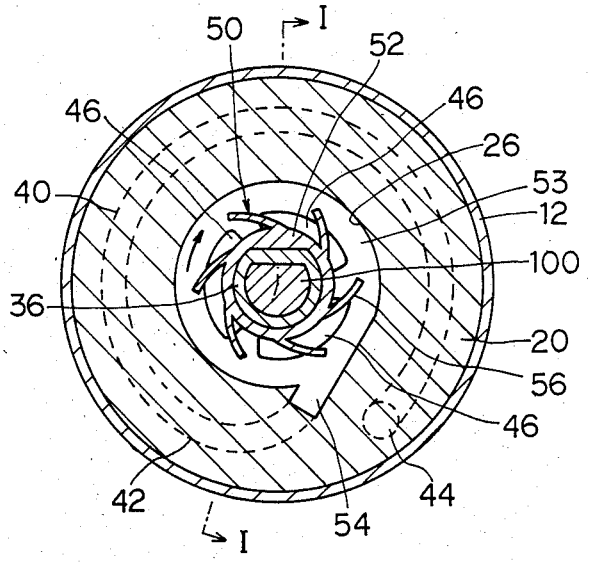
FIG. 3 is a cross-sectional view of a first pump section taken along a line III—III in FIG. 1.

Referring to FIGS. 1 to 3, an electrically operated fuel pump apparatus generally designated by reference numeral 10 includes a cylindrical metal casing 12, a fuel pump section 14 arranged at a vertically lower side of the casing 12 and an electric motor section 16 for driving the fuel pump.

The fuel pump section 14 has a pump housing 18 firmly fixed to the lower end of the casing in a fluid sealing manner. The pump housing 18 is comprised of a first housing part 20 made of Aluminum and a second housing part 22 also made of Aluminum and attached to the first housing part at its circular peripheral portion. A fuel inlet port 24 is formed at a central portion of the first housing part 20 and a first circular recess 26 is formed at an opposite side of the housing part 20 and concentrically with the fuel inlet port 24. A bearing bore 28 is formed at a central portion of the second housing part 22, and a second recess 32 and a third recess 30 having a smaller diameter and a larger depth than the second recess are formed at a lower side of the housing part 22 to form a chamber defined by the housing parts 20 and 22. A vapor discharge passage 48 is further formed in the second housing part 22, which is communicated at its one end with the chamber defined by the third recess 30 and is inclined from the one end to a vertically higher point so that a fuel vapor in the recess 30 can easily flow out of the recess through the passage 48. An opening 60 is formed in the casing 12 to be communicated with the other end of the passage 48.

A lower end of a motor shaft 100 is rotatably held by a bearing 102 inserted into the bearing bore 28, and is projecting into the chamber defined by the housing parts 20 and 22. The projecting end has a D-shaped cross-sectional configuration.

A disc-like metal impeller 34 is rotatably arranged in the chamber defined by the second recess 32 and a vertically upper surface of the first housing part 20. A central boss portion 36 of the impeller has a D-shaped opening, through which the lower end of the motor shaft 100 is inserted so that the impeller 34 is operatively connected to the motor shaft 100 and is axially movable with respect to the motor shaft. The impeller 34 is provided with circumferential rows of circumferentially spaced radial vane grooves 38 formed in the opposite end faces of the impeller adjacent to the outer periphery thereof.

A pair of annular grooves are formed at a vertically upper surface of the first housing part 20 and a vertically lower surface of the second housing part 22, which are facing to each other to form an annular pump passage 40 surrounding the outer periphery of the impeller 34. The pump passage 40 is circumferentially interrupted between an inlet portion 42 and an outlet portion 44 as shown in FIG. 2 and this interrupted portion is sealed by the housing parts 20 and 22 so that fuel leakage from the outlet portion 44 to the inlet portion 42 can be prevented. The outlet portion 44 is communicated with the motor section 16 to supply pressurized fuel thereinto. The above described pump section constitutes a second stage (regenerative type) pump section of the present invention. A diameter and a thickness of the impeller 34 are, for example, 40 mm and 2.8 mm, respectively.

A first stage pump section of the invention will be explained hereinafter.

An (first) impeller 50 of a centrifugal type is operatively connected at its boss 52 to a vertically lower surface of the (second) impeller 34 and is arranged within the recess 26 of the housing part 20 and concentrically with the second impeller 34, whereby a first pump passage 53 is formed by the lower surface of the impeller 34, surfaces of the recess 26 and an outer peripheral portion of the boss 52. A connecting passage 54, which is extending tangentially to the circular side surface at an outlet portion of the first pump passage 53, is formed in the first housing part 20 for connecting the outlet portion of the first pump passage 53 and the inlet portion 42 of the (second) pump passage 40 of the second stage pump section.

A diameter of the first impeller 50 is made smaller than that of the second impeller 34 and a plurality of vapor discharge ports 46, circumferentially spaced from each other, are formed in the second impeller 34 so that the first pump passage 53 is communicated with the chamber defined by the third recess 30 at a vertically upper side of the second impeller 34. As seen from FIGS. 1 to 3, the vapor discharge ports 46 are of an arcuate shape and are formed at such a position where the discharge ports open to the radially inward portion of the first pump passage 53, namely in the embodiment in FIGS. 1 to 3, the vapor discharge ports 46 are formed at a radially inside portion with respect to the outer ends of vanes 56 of the first impeller 50.

With respect to the motor 16, it has been described that the impellers 34 and 50 of the pump section are mounted on one end of the motor shaft 100. The other end of the motor 100 is journalled by a second bearing 122 which in turn is mounted by a rocking washer 118 on the other end wall 112 of the casing 12. The end wall 112 forms a bearing holder and is fitted into the end of the pump casing 12 remote from the pump section. Permanent magnets 104 are secured to the inner peripheral surface of the casing 12 by any conventional securing means. An armature 106 is mounted on the motor shaft 100 and aligned with the magnets 104. A commutator 108 is mounted on the motor shaft 100 adjacent to the armature 106. A brush 110 is mounted by a brusher holder 114 on the bearing holder 112. A fuel delivery port 124 is formed centrally of the bearing holder 112 while fuel discharge passages 116 are formed in the end wall or bearing holder 112 around the bearing 122 to provide communication between the fuel delivery port 124 and the space within the motor section 16.

The fuel pump 10 of the construction and arrangement described is usually installed in a fuel tank of a vehicle in such a manner that the motor shaft 100 is aligned with a vertical line.

In operation, when an electric power is supplied to the motor section 16, the armature 106 is rotated and the rotation of the motor shaft 100 is transmitted to the impellers 34 and 50. The fuel in the fuel tank (not shown) is sucked into the first pump passage through the inlet port 24, the sucked-in fuel is agitated by the rotating first impeller 50 and thereby the fuel vapor is separated from the liquid fuel due to a difference of centrifugal forces applied to the fuel vapor and the liquid fuel. The separated fuel vapor is gathered at the radially inward portion of the first pump passage 53 and exhausted therefrom through the vapor discharge ports 46, the recess 30, the vapor discharge passage 48 and the opening 60 to the fuel tank.

The separated liquid fuel is pre-pressurized at the first stage pump section and is supplied to the second stage pump section through the outlet portion 53 of the first pump passage and the connecting passage 54. Although the fuel is again agitated by the impeller 34 in the second stage pump section, the fuel vapor is hardly produced since the fuel vapor is already separated at the first stage pump section and the fuel in the second stage pump section is already pressurized to some degree at the first stage pump section.

The fuel is therefore effectively pressurized in the second stage pump section and fed to injection nozzles (not shown) through the outlet portion 44, the motor section 16 and the fuel delivery port 124.

Figure 4:
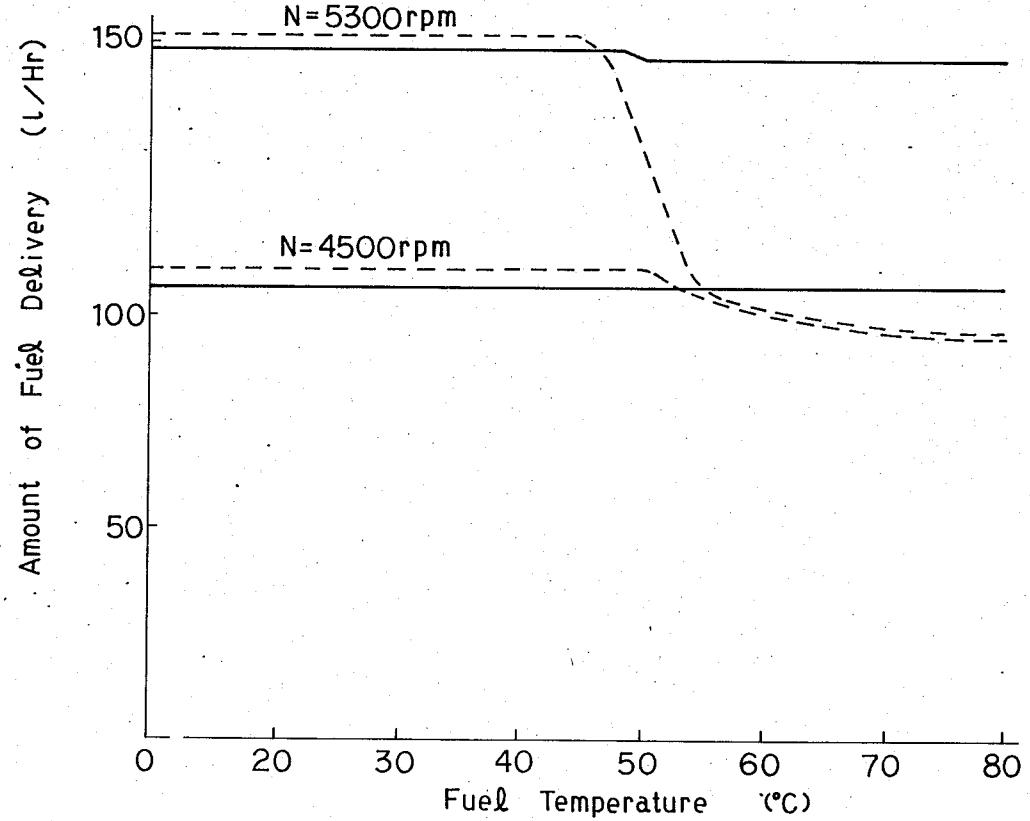
FIG. 4 is a graph showing experimental results with respect to the first embodiment.

FIG. 4 shows experimental results conducted by the present inventors, wherein solid lines show amounts of fuel delivery at different fuel temperatures when the pump apparatus of the present invention is operated at 4,500 rpm and 5,300 rpm, while the dotted lines show the test results of the conventional fuel pump apparatus. As seen from FIG. 4, when the fuel temperature exceeds 45° C., the amount of fuel delivery of the conventional pump apparatus is remarkably decreased, while the pump apparatus of the present invention supplies a stable amount of fuel even above 50° C. of the fuel temperature. The above test results show us that the pump apparatus of the present invention has a more durability to the vapor-lock.

Figure 5:
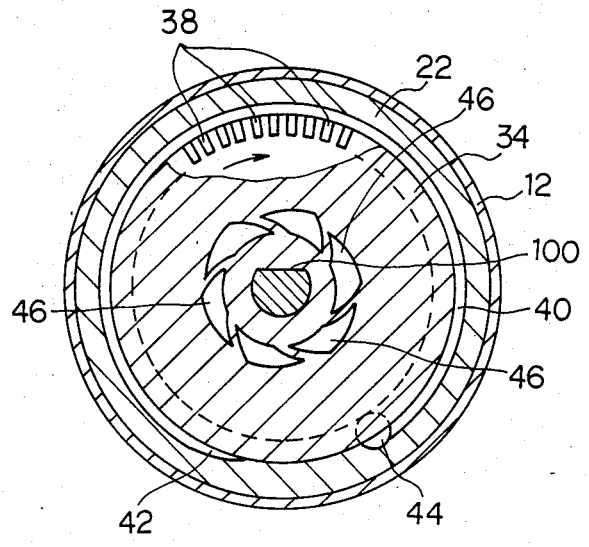
FIGS. 5 and 6 are sectional views showing a modification of the first embodiment.
Figure 6:
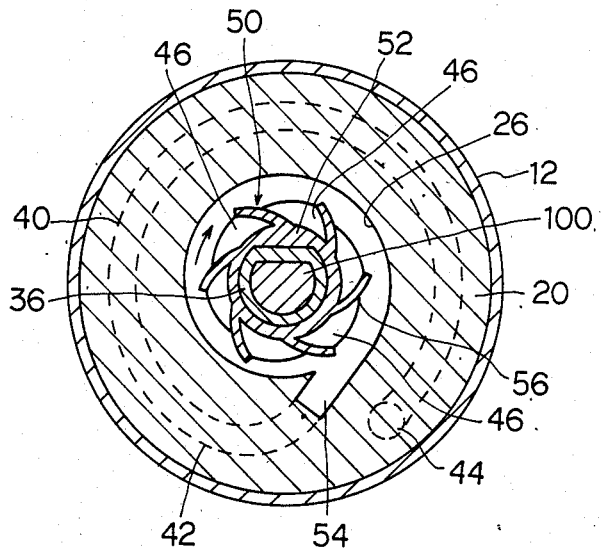

FIGS. 5 and 6 show a modification of the above described first embodiment, wherein the vapor discharge ports 46 are so formed that a configuration of each port substantially corresponds to a space between adjacent vanes 56 of the first impeller 50.

Figure 7:
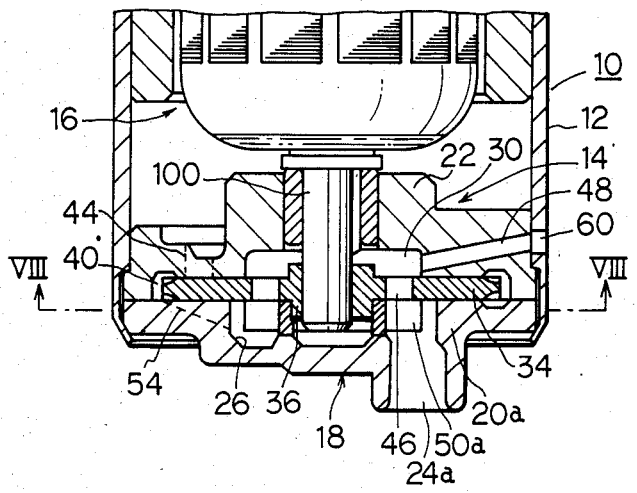
FIG. 7 is an axial sectional view of a pump section according to the second embodiment.
Figure 8:
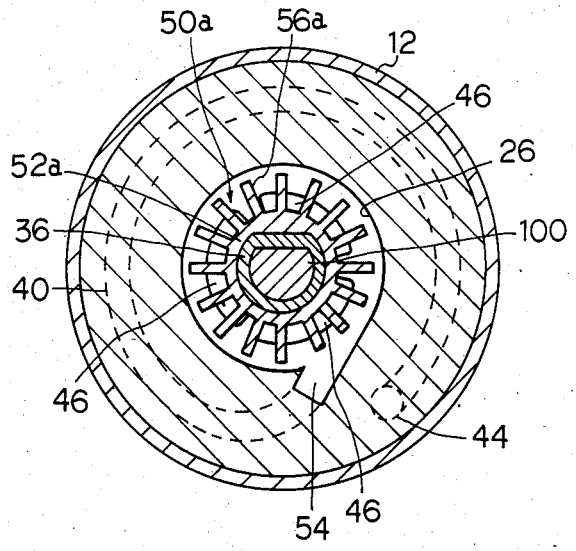
FIG. 8 is a cross-sectional view taken along a line VIII—VIII in FIG. 7.

FIGS. 7 and 8 show a second embodiment of the present invention, wherein an impeller **50*a* of the first stage pump section is comprised of a regenerative type impeller having open-type vanes 56*a*. Since the first impeller 50*a* is of the regenerative type, an inlet port 24*a* is formed in a first housing part 20*a* at such a position where it is radially offset from an axial line of the motor shaft 100**.

Although the invention is described with reference to the specific embodiments, it is not to be limited thereto and any modification can be easily done without departing from a spirit of the invention defined in the appended claims.

What is claimed is:

1. A fuel pump to be positioned in a fuel tank of an internal combustion engine the fuel pump having a pump housing and an upright drive shaft, comprising:

(1) a first stage pump section including (a) a first pump passage formed in said pump housing and communicated at one end with an inlet port of said pump housing;

(b) a first impeller operatively connected to said shaft and operatively arranged in said first pump passage for separating, during rotation thereof, fuel vapor from liquid fuel, introduced from said inlet port, within said first pump passage and pressurizing said liquid fuel; and (2) a second stage pump section including (c) a second pump passage formed in said pump housing and communicated at one end to the other end of said first pump passage and at the other end to an outlet port of said pump;

(d) a second impeller operatively arranged in said second pump passage and operatively connected to said first impeller for further pressurizing the liquid fuel supplied from said first pump passage, said second impeller having a larger diameter than said first impeller, said second impeller being arranged at a vertically upper side of said first impeller;

(e) a vapor discharge port formed in said second impeller at a radially inward portion facing said first impeller and communicated at a vertically lower side thereof with the radial inward portion of said first pump passage for causing the fuel vapor separated on said first impeller to flow vertically and upwardly therethrough; and (f) a vapor discharge passage formed upwardly and radially in said pump housing for communicating a vertically upper side of said vapor discharge port with the outside of said pump within the fuel tank, whereby the fuel vapor flowing out of said vapor discharge port is returned to a portion within the fuel tank vertically higher than said inlet port wherein said first impeller is of a centrifugal type, and said second impeller is of a regenerative type.

2. A fuel pump apparatus as set forth in claim 1, wherein said first impeller is of a regenerative type having open vanes.

3. A fuel pump apparatus as set forth in claim 1, wherein said first impeller is attached to a vertically lower surface of said second impeller.

4. A fuel pump apparatus as set forth in claim 3, wherein said vapor discharge port has a configuration substantially corresponding to a space defined between adjacent vanes of said first impeller.

5. A fuel pump apparatus for an internal combustion engine having a fuel tank comprising:

a pump housing having a fuel inlet and a fuel outlet to be positioned within a fuel tank so that said fuel inlet is positioned lower than said fuel outlet;

an electric motor having a vertical rotatable shaft extending into said pump housing;

a first pump passage formed in said pump housing in communication with said fuel inlet;

a first impeller connected to said rotatable shaft and arranged in said first pump passage for separating, when driven by said electric motor, fuel vapor from liquid fuel introduced from said inlet port thereinto and pressurizing said liquid fuel;

a second pump passage formed in said pump housing in communication with said first pump passage and said fuel outlet and having a larger diameter than said first pump passage, said second pump passage being positioned upwardly and downwardly of said first pump passage and said fuel output, respectively;

a fuel passage formed in said pump housing and communicating radially outer peripheral portions of said first pump passage and said second pump passage with each other;

a second impeller connected to said rotatable shaft and arranged in said second pump passage for further pressurizing, when driven by said electric motor, the liquid fuel introduced from said first pump passage to said second fuel passage through said fuel passage so that the further pressurized liquid fuel is supplied through said fuel outlet;

a vapor discharge port formed in said second impeller at a radially inward portion thereof facing said first impeller to communicate with said first fuel passage so that the separated fuel vapor flows upwardly from said first pump passage therethrough;

a third fuel passage formed in said pump housing in communication with said vapor discharge port to receive the separated fuel vapor from said vapor discharge port, said third fuel passage being positioned upwardly of said second fuel passage and said vapor discharge port; and a vapor discharge passage formed in said pump housing in communication with said third fuel passage and the exterior of said pump housing within the fuel tank, said vapor discharge port extending gradually outwardly and upwardly from a peripheral portion of said third fuel passage so that the separate fuel vapor in said third fuel passage is discharged therethrough to the exterior of said pump housing within the fuel tank wherein said first impeller is of a centrifugal type, and said second impeller is of a regenerative type.

6. A fuel pump according to claim 1 wherein said second stage impeller has vanes at a peripheral portion thereof.

7. A fuel pump according to claim 5 wherein said second stage impeller has vanes at a peripheral portion thereof.

8. A fuel pump according to claim 1 wherein said first and second pump passages are communicated by a connecting passage extending tangentially and upwardly from said first pump passage.

9. A fuel pump according to claim 5 wherein said first and second pump passages are communicated by a connecting passage extending tangentially and upwardly from said first pump passage.

* * * * *